United States Patent [19]

Schroeder et al.

[11] Patent Number: 4,705,114

[45] Date of Patent: Nov. 10, 1987

[54] OFFSHORE HYDROCARBON PRODUCTION SYSTEM

[75] Inventors: Warren W. Schroeder, Aberdeen, Scotland; Eric B. Turner, Hindhead, England

[73] Assignee: Texaco Limited, London, England

[21] Appl. No.: 810,617

[22] Filed: Dec. 19, 1985

[30] Foreign Application Priority Data

Jul. 15, 1985 [GB] United Kingdom ..... 8517760

[51] Int. Cl.[4] ..... E21B 43/017; E21B 43/36

[52] U.S. Cl. ..... 166/357; 166/267; 166/366

[58] Field of Search ..... 166/357, 344, 345, 366, 166/367, 68, 68.5, 67, 105, 105.5, 105.6, 242, 265, 267, 369, 52; 55/199

[56] References Cited

U.S. PATENT DOCUMENTS

| | | | |
|---|---|---|---|
| 2,910,002 | 10/1959 | Morgan | 166/105.5 |
| 3,261,398 | 7/1966 | Haeber | 166/357 |
| 3,384,169 | 5/1968 | Leonard | 166/267 |
| 3,608,630 | 9/1971 | Wooden et al. | 166/357 |
| 3,754,380 | 8/1973 | McMinn et al. | 166/357 |
| 3,875,998 | 4/1975 | Charpentier | 166/357 |
| 3,881,549 | 5/1975 | Thomas | 166/357 |
| 4,109,478 | 8/1978 | Gracia | 175/9 |
| 4,371,037 | 2/1983 | Arnandean | 166/366 |
| 4,506,735 | 3/1985 | Chandot | 166/357 |
| 4,527,632 | 7/1985 | Chandot | 166/357 |

FOREIGN PATENT DOCUMENTS

| | | | |
|---|---|---|---|
| 81/01310 | 5/1981 | Pct Int'l Appl. | 166/357 |

*Primary Examiner*—James A. Leppink
*Assistant Examiner*—Huang C. Dang
*Attorney, Agent, or Firm*—Robert A. Kulason; James J. O'Loughlin; Robert B. Burns

[57] ABSTRACT

A subsea system for transmitting a multiphase flow of hydrocarbons produced from a subsea well positioned remotely from fluid storing and treating facilities. The system includes a subsea well template which encloses a plurality of well heads. A composite hydrocarbon flow is manifolded from the respective wells and conducted to a fluid separator which causes the composite stream to separate into discrete liquid and vaporous flows. The latter are then conducted through a multi-conductor riser to the treating and storage facility.

4 Claims, 4 Drawing Figures

OFFSHORE HYDROCARBON PRODUCTION SYSTEM

BACKGROUND OF THE INVENTION

In the production of hydrocarbons such as gas and crude oil from subsea wells, similarly to land based wells, fluid is normally urged to the surface by gas pressure within the subterranean formation. As the multiphase, liquid gaseous flow is received at the surface of the water, it is separated into discrete components. If the primary flow is in the form of liquid, the gas is often flared off or otherwise disposed of. When the gaseous element constitutes a considerable proportion of the overall flow, it can be treated and further used commercially.

In the instance of some subterranean formations, the hydrocarbon liquid can only be recovered or produced with the aid of some form of reservoir enhancement. At some locations for example, production can be fostered by the pressurized injection of water into the formation. Such an injection or flooding process urges the oil through the reservoir and toward one or more producing wells where a composite stream of water, oil, and gas can be readily produced.

A further facility for raising crude oil to the surface under reduced low pressure conditions is by a gas assist or gas lift procedure. In this method, gas is intermixed with the crude oil in an amount, and in such a manner, to decrease the viscosity and specific gravity of the liquid. The latter can then be more readily raised from a subterranean reservoir to the water's surface.

In either instance, the composition of the produced crude product will normally embody a mixture or emulsion of cruse oil, gas, and water. As this emulsion is brought to the surface it is treated to permit individual streams of the water, oil and gas to be either further used, transported or otherwise disposed of for commercial purposes.

Where the composite or integrated hydrocarbon stream is transmitted from an underwater well to a remotely positioned facility, there will be a propensity for the various elements to separate out. More specifically, as the composite stream is pushed or urged across the ocean floor, there will be a considerable amount of heat transfer between the stream and the surrounding environment. Where the water constitutes a relatively cold environment, a substantial amount of heat will be lost through the conductor walls.

When the product transmission takes place over a relatively long distance, particularly along the sea floor, separation of the stream into discrete components will form discrete slugs of liquid and gas which are moved toward the processing equipment. It can be appreciated that eventually the crude oil and the gas will arrive at the processing facility in a condition where the liquid must be pumped from the ocean floor to separating and treating equipment on a marine structure or onshore.

It can be further appreciated that under these circumstances where a pumping facility is utilized to lift the liquid component, introduction of a substantial amount of gas into the pump inlet will result in erratic operation of the pump. The normal consequence is a sporadic flow of hydrocarbon to the surface positioned processing equipment.

Toward overcoming these inherent problems in the production of oil and gas from an offshore location, there is presently provided means for producing and transmitting a composite or integrated flow of gas, oil and water across a relatively long distance prior to the stream being lifted to a surface positioned treating and storing facility. The composite flow is initially directed through a pipeline along the ocean floor. At the terminal point such as a marine structure, platform or the like, the composite stream is delivered to a multiphase separator. In the latter, the stream is segregated into discrete liquid and gaseous segments.

The gaseous segment is delivered to the deck of the platform apart from the liquid flow. In the instance of the latter, the water-oil emulsion is first accumulated in a subterranean sump or reservoir prior to being removed at a controlled rate.

It is therefore an object of the invention to provide a subsea production and product transmission system which is capable of conducting a composite, multiphase stream of produced product to a fluid separator and thence to fluid processing equipment.

A further object is to provide a subsea system which includes a plurality of satellite wells which are remote from, and communicated with processing equipment.

Another object is to expand the use of a fixed, offshore structure to accommodate an increased volume of hydrocarbons for processing, without adding substantially to the structure's weight.

A still further object is to provide a self-supporting, fluid conducting riser for use on an offshore fluid processing installation.

Figure 1:
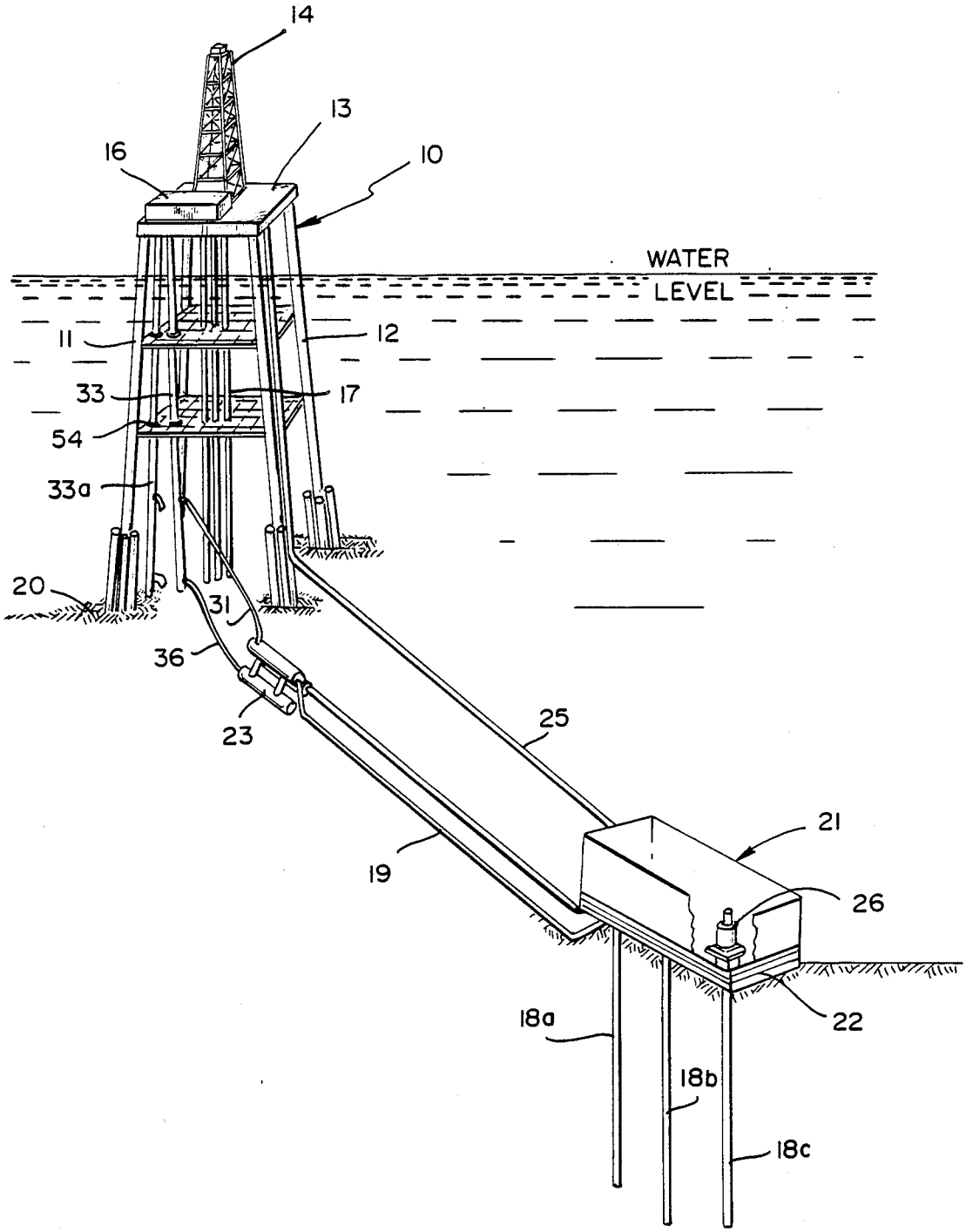
FIG. 1 is an environmental view of an offshore installation of the type presently contemplated.

Referring to the drawings, a system of the type presently contemplated is shown, including primarily a marine structure or platform 10 which is fabricated primarily of welded steel components. The latter, particularly legs 11 and 12, form an elongated jacket of sufficient depth to hold a working deck 13 above the water's surface. The jacket is normally piled at its lower end to the ocean floor to assure stability under adverse weather conditions.

The upper end of structure 10 is provided as noted with working deck 13 which includes the normal operating equipment such as derrick 14 and/or associated equipment 16 for drilling wells into the ocean floor and for processing produced fluids. The latter usually includes equipment to initially receive, treat and temporarily store produced product.

Normally, subsea wells are drilled sequentially through a plurality of conductors 17 which extend vertically through the jacket, from deck 13 to the sea floor 20. Thereafter, a rotating drill string which is lowered by derrick 14 through a conductor 17, will commence a well which can thereafter be diverted into a desired direction.

In the present arrangement, a plurality of wells represented by 18*a*, 18*b* and 18*c*, are positioned on ocean floor 20 remotely from the marine structure 10. Said wells, often designated as satellite wells, are preferably drilled into a common productive formation or reservoir several miles from structure 10. The product is thereafter manifolded and conducted through a pipeline 19 along the ocean floor to processing equipment 16 on deck 13.

As shown, remote wells 18*a, b* and *c* are enclosed within a protective template 21. The latter comprises primarily a subsea structure adapted to accommodate and guide a drill string which is lowered from a vessel, to drill the respective wells in a group adjacent one to the other.

Template 21, which is fixed to the ocean floor, although not presently shown in detail, is provided with guide cables to removably receive a blowout preventer during the well drilling period and to position the usual casing, well head and Christmas tree 26, after a well has been formed and is ready to flow.

When the well or wells prove to be producers, following usual practice the blowout preventer is removed from the well head and replaced with a Christmas tree 26. The latter includes the necessary equipment for regulating the outflow of hydrocarbon fluid normally in the form of gas, oil and water from the respective wells to the marine structure 10. This aggregation of flows from several closely grouped wells is achieved through a manifold system 22 carried on template 21. The latter, as noted above, communicates with pipeline 19 to carry a regulated flow of produced fluid to a subsea separator 23 at marine structure 10.

To provide the satellite or remote wells 18*a, b* and *c* with the necessary gas, water or chemicals to promote production of hydrocarbon fluid, conduit means 25 extends from a source of said elements at the marine structure 10, along the ocean floor, to the subsea template 21. At the latter, the various incoming fluids are communicated with, and distributed through the manifold system. Thus, any one or more of the remote wells is selectively provided with necessary injection or treating fluid as needed.

Since the normal product flow between template 21 and platform 10 will be in the form of a composite, liquid gas stream, the need for fluid separator or slug catcher 23 is essential. Said member functions to attenuate the multiphase flow, to separate the respective elements, and to thereafter direct them individually to processing equipment 16 on the marine structure's deck 13.

Figure 2:
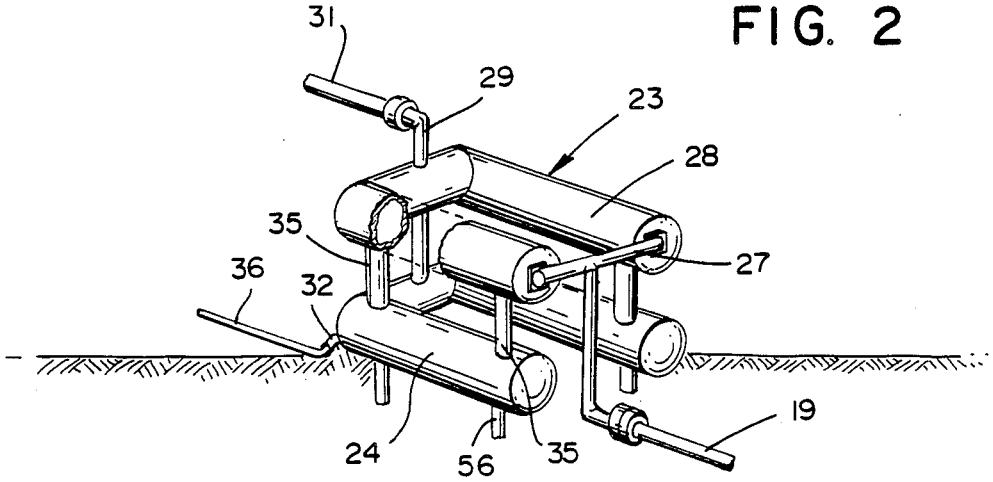
FIG. 2 is a segmentary view of the apparatus in FIG. 1.

As here shown in FIG. 2, and as is generally known to the industry, subsea fluid separator 23 in its basic form, is comprised of a subsea unit which incorporates one or more elongated, tubular chambers. The separator is provided with an inlet manifold 27 which is communicated with pipeline 19, and through which the composite flow of produced fluid is introduced for separation in uppermost separating chamber 28.

Through the natural separation of gas and liquid, separator 23 will permit gas to rise through the upper separation chamber 28. The liquid component will gravitate through conductors 35, and be accumulated at the lower chamber 24.

Separator 23 in the usual manner, although not shown, is provided with pig receiver means for accommodating cleaning pigs. The latter are run through pipeline 19 between the separator and the satellite template manifold 22 to maintain the integrity of fluid carrying lines.

Preferably, separator 23 is supported on the ocean floor immediately adjacent to the foot of the marine structure 10, by piles 56. Conduit means 36 and 31 are communicated with the respective chamber outlets 29 and 32 to allow discrete flows of gas and liquid to be conducted from separator 23.

Referring to FIG. 1, transmitting fluids from the ocean floor 20 to deck 13 to platform 10 through a depth of several hundred feet can engender a number of problems. In the present arrangement, at least one, and preferably a plurality of risers or receptor columns 33 and 33*a* are provided in or contiguous with platform 10. These risers are normally positioned adjacent to upright conductors 17 which extend from the ocean floor 20 to the deck 13. Together they function to conduct a production stream as well as a test stream of product to deck 13.

Figure 3:
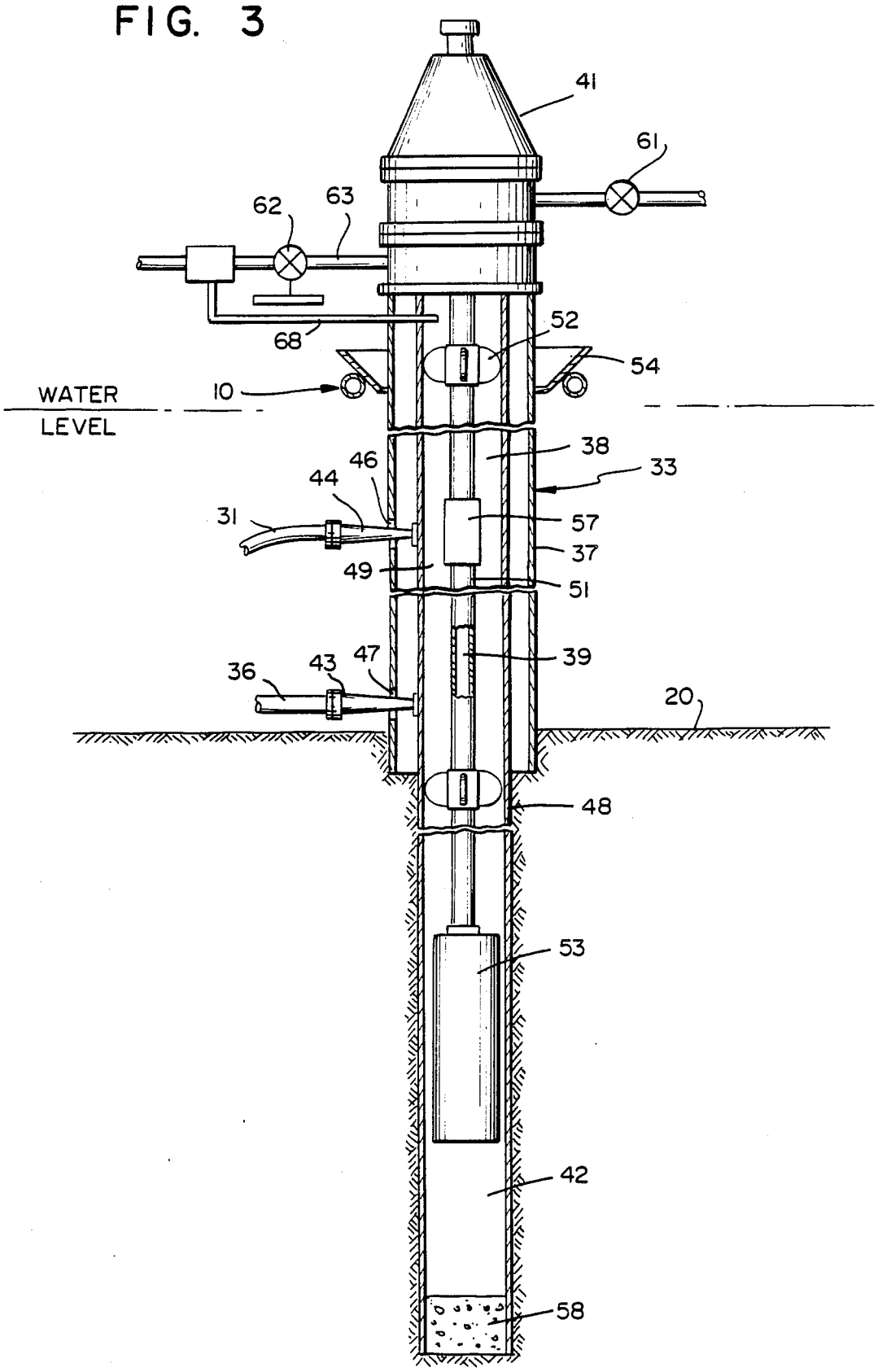
FIG. 3 is a segmentary view of the apparatus in FIG. 1.

Referring to FIG. 3, each riser, 33 for example, comprises an elongated member or column 37 having a plurality of discrete longitudinal passages 38 and 39 therethrough. Said elongated passages carry separate flows of gas and liquid to a manifold cap 41 at the riser upper end. The latter directs the liquid and/or gas through control valves 61 and 62 to the necessary processing and storing equipment 16 for treatment prior to being stored or otherwise shipped to a shore installation.

Riser 33 as mentioned, is comprised of an elongated column 37 and includes a casing 48 which is embedded at its lower end into the ocean floor 20. The column is preferably formed of tubular steel and is driven or drilled into the ocean floor a sufficient distance to define an elongated liquid holding sump 42.

To minimize the weight imposed on the marine structure 10, riser 33 can be lowered through vertically aligned conductor guides 54 in the platform jacket and thus be vertically positioned and virtually self supporting. The column's lower casing end 48 is provided with a suitable cement plug 58 or the like to define the sump floor.

Column 37 is preferably comprised of a series of pipe lengths which are fastened end to end to provide the desired overall length. Said column is further provided with horizontal side ports 46 and 47 for registering liquid nozzle 43 and vapor nozzle 44 therein.

Internally, riser 33 is provided with an elongated casing 48 which extends coextensively with, and protrudes from column 33 lower end, thereby defining an annulus 49. Elongated tubing 51 is suspended within casing 48 and includes a series of vertically spaced stabilizers 52 which comprise in effect arms which radiate outwardly to engage the adjacent casing wall.

A downhole pump 53 is suspended, or depends from tubing 51. Said pump includes one or more inlets which open into sump 42 within casing 48. Liquid crude oil and water which accumulate in sump 42 are thus urged upwardly through said tubing 51 to manifold cap 41. Bypass means 68 is included in conjunction with pump 53 and riser 33, to recirculate pumped liquid from line 63 into annulus 49, thence to the pump inlet. Therefore, should the supply of liquid in sump 42 become depleted, pump 53 will continue to function in a pumping capacity, handling an amount of recirculated liquid.

Riser 33 as here used, serves as a conductor for two individual and separate flows. In brief, the flow of liquid through the central pipe 51 is completely segregated from gaseous flow which passes upward through annular passage 49, both of which terminate in manifold cap 41.

Vapor or gas is introduced to the annulus 49 by way of inlet nozzle 44 which communicates conduit 31 to the separator 23 upper chamber 28. The pressurized gas stream entering annulus 49 is impinged against a shield 57 which surrounds the central pipe 51 thereby protecting the latter from erosion due to contact with the entering gas stream.

At the sea floor 20, the liquid segment including primarily crude oil and water is introduced to sump 42 by way of inlet nozzle 43. The latter is communicated with the lower chamber 24 of separator 23 by way of conduit 36. Thus, liquid received from said chamber 24 flows by gravity into the sump 42. The latter which extends several hundred feet into the ocean floor, provides a continuous liquid head on downhole pump 53. The result will be a substantially continuous upward flow through pipe 51 to the processing storage equipment 16 on deck 13.

Figure 4:
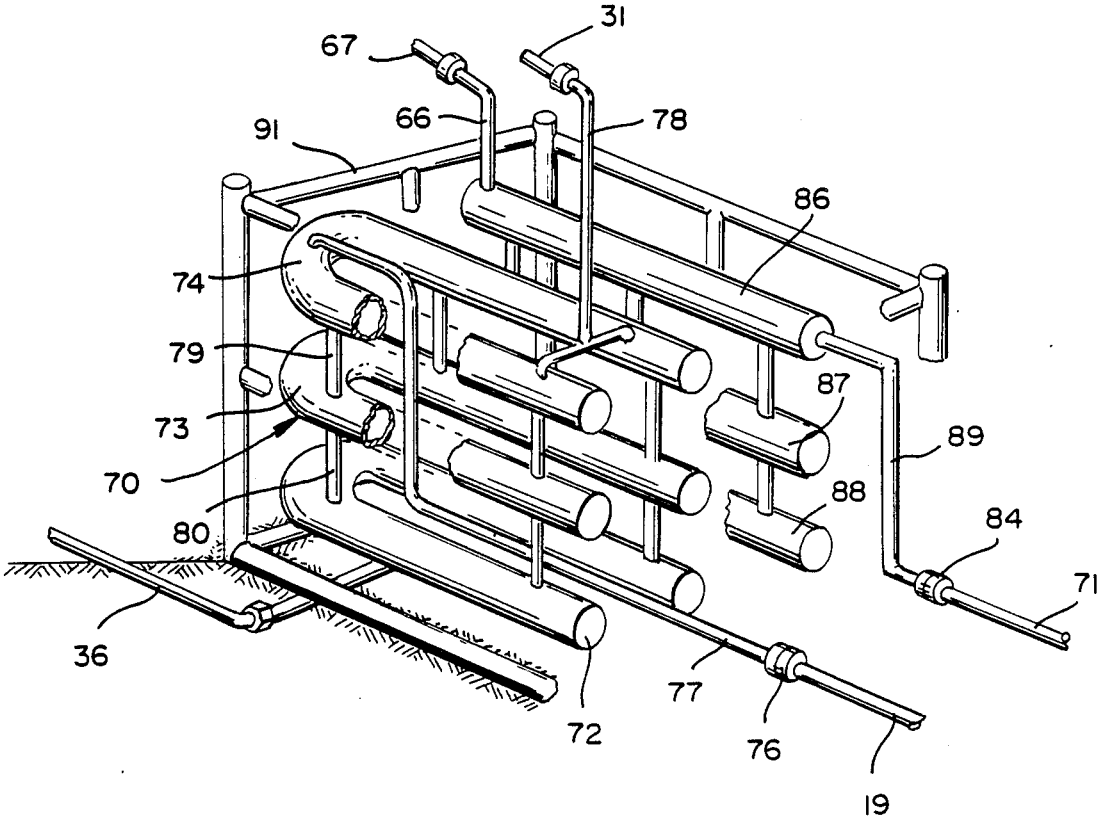
FIG. 4 is an alternate embodiment of the apparatus of FIG. 2.

Referring to FIG. 4, in an alternate embodiment of the disclosed slug catching apparatus 70, means is provided for receiving two distinct composite flows from template 21 by way of conduits 19 and 71, respectively. One such flow from conduit 71 will be restricted for test purposes and will consequently comprise a relatively minor stream of fluid. The other flow will be of a production or volumetric nature and consequently will embody a relatively major flow.

The production flow handling phase of the slug catching apparatus 70 includes at least three tiers of fluid holding chambers identified generally as 72, 73 and 74. Each chamber is fabricated of a generally U-shaped tubing member, said members being arranged in vertical spaced relationship one above the other. The entire tubing array is supportably enclosed within a protective although open framework 91 to avoid possible damage to operating components of the unit. As in the slug catching apparatus 23 disclosed herein, the structure is fixed to the ocean floor as by piling, and is preferably supported in such manner to permit it to assume a level disposition.

Again referring to FIG. 4, when this embodiment is the slug catching element, the main composite stream of gas and liquid is conducted to slug catcher 70 as noted above by conduit 19. The latter is communicated at a flanged joint 76 with a riser 77 which communicates with the upper tubing member 74. In the top or separating section, gas and liquids will separate out, the gaseous component being conducted through discharge line 78 to the flexible conduit 31, which in turn communicates with vapor nozzle 44 on riser 33.

From separating chamber 74, the liquid component will flow by gravity through connecting pipes 79 to the center chamber 73. The latter chamber, during a normal operation will function to avoid surging in the system by alternately filling and draining.

From intermediate chamber 73, liquid will flow by downcomer pipe 80 to lower chamber which thereby provides a partial reservoir, functioning to keep the slug catcher from running dry. This measure will in turn assure that the liquid level in the riser 33 will remain essentially constant.

Fluid level within the slug catcher 70, is achieved through an array of interoperating switches. The latter, although not shown in detail, comprise primarily a series of nucleonic density switches which function in conjunction with the respective slug catcher chambers 72, 73 and 74. To maintain a controlled flow of liquid levels, preferably in the slug catcher chamber 72 signals. These are transmitted by cable to a microprocessor based controller. The latter then are fed to an actuator which activate flow control valve 62 thereby regulating the flow of liquid product from the pump 53 in response to outflow of liquid from the slug catcher.

Operationally, the flow regulating microprocessor is provided with a resident data base which is continuously updated with known liquid slug flow historical data. The latter in turn is utilized to assure a constant controlled liquid flow throughput to the deck based equipment 16 while fluid holding chamber 73 at separator 70, alternately fills and drains.

Thus, from lower chamber 72, the fluid which has drained from the upper chambers 73 and 74 will be conducted to riser 33 by way of conduit 36 and nozzle 43 to deposite said liquid into sump 42.

As noted above, slug catcher 70 is provided with a secondary or ancillary fluid separating system adjacent to the primary or main flow system. The secondary system for receiving a test or second flow of fluid, includes vertically positioned upper chamber 86, intermediate chamber 87 and lower chamber 88. The upper chamber 86 is communicated with test flow conduit 71 through coupling 84 whereby a flow of the composite fluid from one or more wells will be carried solely for test purposes. An outflow of gas will pass from conductor 66, through conductor 67, and thence to riser 33*a*.

Thus, flow from conduit 71 is introduced to riser 89, which in turn communicates with the upper chamber 86 in which the basic separation takes place. Thereafter, the progressively descending liqud will be carried from the lower compartment 88 and transmitted to riser 33*a* and thereafter to deck 13.

It is understood that although modifications and variations of the invention may be made without departing from the spirit and scope thereof, only such limitations should be imposed as are indicated in the appended claims.

We claim:

1. In an offshore marine structure having a jacket which supports a work deck above the surface of a body of water, a fluid receiving means on said work deck for receiving liquid and vaporous hydrocarbons which are conducted thereto, a pipeline on the floor of a body of water carrying a composite hydrocarbon stream including liquid and vaporous hydrocarbon, subsea separating means at said marine structure communicated with said pipeline to receive said composite hydrocarbon stream, the combination therewith of, a fluid conducting receptor column in said jacket defining a plurality of concentrically arranged discrete passages, a first conductor means communicating one of said discrete passages with said subsea separating means and receiving a gaseous hydrocarbon stream therefrom, second conductor means communicating another of said concentric passages with a source of liquid hydrocarbon at said subsea separating means, and pumping means in said concentric passage which receives liquid hydrocarbons.

2. In the apparatus as defined in claim 1, wherein said fluid conducting receptor column is self supporting in an upright position thereby exerting minimal bearing weight on said jacket.

3. In the apparatus as defined in claim 1 wherein said fluid carrying receptor column is laterally engaged and slidably registered in said jacket to be laterally engaged by said jacket and maintained in said upright position.

4. In the apparatus as defined in claim 1, wherein said jacket includes a plurality of vertically spaced conductor guides for guiding drilling conductors to the ocean floor and said receptor column is positioned within a vertically arranged series of said conductor guides.

* * * * *